US010758924B2

(12) United States Patent
Kang

(10) Patent No.: US 10,758,924 B2
(45) Date of Patent: Sep. 1, 2020

(54) RECEPTACLE FOR MIXING OF DIFFERENT MATERIALS

(71) Applicant: Seong Il Kang, Gyeonggi-do (KR)

(72) Inventor: Seong Il Kang, Gyeonggi-do (KR)

( * ) Notice: Subject to any disclaimer, the term of this patent is extended or adjusted under 35 U.S.C. 154(b) by 0 days.

(21) Appl. No.: 16/478,311

(22) PCT Filed: Jan. 11, 2018

(86) PCT No.: PCT/KR2018/000551
§ 371 (c)(1),
(2) Date: Jul. 16, 2019

(87) PCT Pub. No.: WO2018/135807
PCT Pub. Date: Jul. 26, 2018

(65) Prior Publication Data

US 2019/0366370 A1 Dec. 5, 2019

(30) Foreign Application Priority Data

Jan. 18, 2017 (KR) ..... 10-2017-0008702

(51) Int. Cl.
*B65D 83/48* (2006.01)
*B05B 11/00* (2006.01)
(Continued)

(52) U.S. Cl.
CPC ..... *B05B 11/3081* (2013.01); *A45D 33/26* (2013.01); *A45D 34/06* (2013.01); *A45D 40/24* (2013.01); *B65D 81/32* (2013.01)

(58) Field of Classification Search
CPC .... B65D 77/08; B65D 81/32; B65D 81/3227; A45D 33/26; A45D 34/06; A45D 40/24;
(Continued)

(56) References Cited

U.S. PATENT DOCUMENTS 2,973,883 A * 3/1961 Modderno ..... B65D 83/682 222/94
7,875,001 B2 * 1/2011 Minotti ..... A61M 15/08 222/137
(Continued)

FOREIGN PATENT DOCUMENTS

JP 06-053454 U 7/1994
JP 2003-252383 A 9/2003
(Continued)

*Primary Examiner* — Luan K Bui
(74) *Attorney, Agent, or Firm* — Novick, Kim & Lee, PLLC; Jae Youn Kim

(57) ABSTRACT

Provided is a receptacle for mixing different materials, including: an outer receptacle for accommodating cosmetic contents; an inner receptacle of a columnar member for accommodating cosmetic contents, the upper part of which is opened and the lower part thereof is closed, which has an upper flange placed over some of the inner circumference of the upper opening portion of the outer receptacle and an elliptical first pump set is inserted into the inside the upper surface thereof; an elliptical second pump set mounted in parallel with the elliptical first pump set on one side of the inner receptacle; a shoulder member, the upper part of which is opened, and on the inner circumference thereof, and an intermediate part is fixed by pressing the upper flange of the inner receptacle and at the same time.

3 Claims, 6 Drawing Sheets

(51) Int. Cl.

| | |
|---|---|
| ***A45D 33/26*** | (2006.01) |
| ***A45D 34/06*** | (2006.01) |
| ***A45D 40/24*** | (2006.01) |
| ***B65D 81/32*** | (2006.01) |

(58) Field of Classification Search

CPC ..... A45D 2200/056; B05B 11/3081; B05B 11/3084

USPC ..... 206/219–221, 568, 581; 222/94, 129, 222/145.1, 145.3, 145.5, 402.1, 545, 546, 222/549

See application file for complete search history.

(56) References Cited

U.S. PATENT DOCUMENTS

| | | | | |
|---|---|---|---|---|
| 2007/0045342 | A1* | 3/2007 | Pigliacampo | A45F 3/20 222/129 |
| 2007/0241114 | A1 | 10/2007 | Roberts | |
| 2011/0226810 | A1* | 9/2011 | Wang | B05B 11/0027 222/129 |
| 2014/0008389 | A1* | 1/2014 | Mekata | B65D 83/20 222/94 |

FOREIGN PATENT DOCUMENTS

| | | | |
|---|---|---|---|
| KR | 20-0294064 | Y1 | 11/2002 |
| KR | 20-2013-0006909 | U | 12/2013 |
| KR | 20-0473944 | Y1 | 8/2014 |

* cited by examiner

RECEPTACLE FOR MIXING OF DIFFERENT MATERIALS

TECHNICAL FIELD

The present invention relates to a receptacle for mixing different materials, and more particularly, to a receptacle for mixing different materials, in which an inner receptacle is inserted into an outer receptacle, and one of pump sets is mounted on the inner receptacle, thereby storing cosmetic contents different from each other in the inner receptacle and the outer receptacle, and using them simultaneously by one pumping.

BACKGROUND ART

When mixing two materials of different ingredients (cosmetics, etc.) in advance, a problem that these materials deteriorate due to chemical reaction in the mixed state or the performance is remarkably degraded may occur. If the user uses the materials by mixture after preparing and storing two containers, respectively, there arises a problem caused by the inconvenience in use.

In order to solve these problems, a receptacle for mixing different materials having a configuration capable of mixing two materials by the operation of the user after separating and storing two materials in one receptacle is devised and used.

FIGS. 4 and 5 are cross-sectional views of a conventional container of mixing different materials.

The conventional container for mixing different materials, as shown in these drawings, includes: a container body portion 111, in which a container storage space 111*a* is formed and a container opening 111*b* is formed at an upper end thereof; s shoulder portion 113 coupled to an upper end of the container body portion 111; an inner cap 112 formed integrally with the shoulder portion 113; a container cap 118 coupled to the shoulder portion 113; a push button 114 disposed on the upper side of the inner cap 112; a pressure tube 119 coupled to the bottom surface of the push button 114; a cylinder 150 installed to communicate with the container storage space 111*a*; a pumping portion 140 interposed between the cylinder 150 and the push button 114; and a secondary storage space portion 160 provided with an auxiliary storage space body portion 161 coupled to the cylinder 150.

The inner cap 112 is formed with a cap hole 112*a* in a central region thereof.

The inner cap 112 having such a configuration is coupled to the shoulder portion 113 so that the cap hole 112*a* communicates with the container storage space 11*a*.

The push button 114 is formed with a "¬"-shaped button flow path 114*a* which connects the bottom surface and the side surface. The push button 114 can move along the height direction of the container body portion 111.

The pressure tube 119 is formed so as to communicate with the button flow path 114*a* and the cap hole 112*a*.

The cylinder 150 is formed with a narrowed portion 151 on a bottom region thereof.

The narrowed portion 151 is formed with a through hole 151*a* on the bottom surface thereof and a cylinder engaging shoulder 151*b* is formed on the inner surface thereof. The pumping portion 140 includes: a ring-shaped pumping piston 141 installed in the cylinder 150; an operating shaft 145 installed to enter into the pressure tube 119 through the pumping piston 141; an operating rod 146 installed in the operating shaft 145; an opening and closing recessed groove portion 147 formed at the lower end of the operating rod 146; a straw support tube 148 installed so that the upper end thereof reaches the bottom surface of the opening and closing recessed groove portion 147 and the lower end thereof passes through the through hole 151*a* to be exposed to the outside of the cylinder 150; a straw 149 installed inside the straw support tube 148; and a return spring 144 installed to support both ends thereof by the push button 114 and the inner cap 112.

The pumping piston 141 is installed to be in close contact with the inner surface of the cylinder 150 such that an intermediate storage chamber 150*a* is formed between the bottom surfaces of the cylinder 150.

In addition, the pumping piston 141 is installed in the cylinder 150 to be spaced apart from the lower end of the pressure tube 119.

Accordingly, when lowering the pressure tube 119 by pressurizing the push button 114, the pumping piston 141 is lowering alone by the distance that the pressure tube 119 is spaced apart from the pumping piston 141, and then can be lowered together with the pressure tube 119.

The operating shaft 145 includes a linear operating shaft body portion 145*b* and a stem 145*c* formed at the lower end of the operating shaft body portion 145*b*.

The inner space of the operating shaft body portion 145*b* becomes the operating shaft flow path 145*a*.

The stem 145*c* pressurizes the pumping piston 141 upward during a lifting operation.

The operating shaft 145 having such a configuration is installed such that the stem 145*c* passes through the pumping piston 141 and the operating shaft body portion 145*b* is coupled to the pressure tube 119. In this way, the operating shaft 145 can move up and down together with the pressure tube 119.

The opening and closing recessed groove portion 147 is formed with a plurality of opening and closing recessed groove flow path forming protrusions 147*a* protruding along the longitudinal direction on the upper side of the outer surface thereof.

The opening and closing recessed groove flow path forming protrusions 147*a* are spaced apart from each other, and thus the opening and closing recessed groove flow path is formed in a space between the opening and closing recessed groove flow path forming protrusions 147*a*.

The straw support tube 148 is formed with a plurality of support tube flow path forming protrusions 148*a* protruding along the longitudinal direction on the upper side of the outer surface thereof.

The support tube flow path forming protrusions 148*a* are spaced apart from each other, and thus a support tube flow path is formed in a space between the support tube flow path forming protrusions 148*a*. The return spring 144 is installed so that both ends thereof are supported by the push button 114 and the inner cap 112.

The auxiliary storage space portion 160 is provided with an auxiliary storage space sealing plate portion 162 formed at the lower end of the straw support tube 148 in addition to the auxiliary storage space body portion 161.

The auxiliary storage space sealing plate portion 162 is formed to be disposed perpendicularly to the longitudinal direction of the straw support tube 148.

The auxiliary storage space body portion 161 has a configuration capable of forming a closed space in cooperation with the straw supporting tube 148, the auxiliary storage space sealing plate portion 162, and the cylinder 150.

The operation of a conventional container for mixing different materials having such a configuration will be described herein with reference to FIGS. 6 and 7. For convenience of explanation, it is assumed that the liquid cosmetics are stored in the inner space of the container body portion 111, that is, the container storage space 111*a*, and the powdered cosmetics are stored in the auxiliary storage space portion 160.

When first pressurizing the push button 114 downward, the pressure tube 119 is lowering alone by a distance spaced apart from the pumping piston 141, and then the pressure tube 119 is lowering together with the pumping piston 141. When the push button 114 is pressurized, an elastic force is accumulated in the return spring 144.

When the pressure tube 119 is lowering, the opening and closing recessed groove portion 147 and the straw support tube 148 are also lowered. Here, the lowering of the opening and closing recessed groove portion 147 is achieved such that the opening and closing recessed groove flow path forming protrusions 147*a* cross the cylinder engaging shoulder 151*b*.

When the straw support tube 148 is lowering, the auxiliary storage space sealing plate portion 162 is also lowered so as to cross the lower end of the auxiliary storage space body portion 161.

When the auxiliary storage space sealing plate portion 162 is lowering, powdered cosmetics stored in the auxiliary storage space portion 160 and liquid cosmetics stored in the container storage space 111*a* are mixed (see FIG. 7).

Next, when the pressure applied to the push button 114 is releasing, the push button 114 lifts to the original position by elastic force accumulated in the return spring 144. When the push button 114 is lifted, the operating shaft 145 and the pumping piston 141 are lifted and the operating shaft flow path 145*a* is closed by the pumping piston 141.

When the operating shaft 145 is lifted, the operating rod 146 and the opening and closing recessed groove portion 147 are also lifted. Here, the lifting distance between the operating rod 146 and the opening and closing recessed groove portion 147 is limited by the engagement action between the opening and closing recessed groove flow path forming portion 147*a* and the cylinder engaging shoulder 151*b*.

When the operating rod 146 and the opening and closing recessed groove portion 147 are lifted, the groove bottom surface of the opening and closing recessed groove portion 147 and the upper end of the straw 149 are spaced apart from each other, and thus the container storage space 111*a* is connected to the intermediate storage chamber 150*a* through the opening and closing recessed groove flow path, which is formed in a space between the straw 149 and the opening and closing recessed groove flow path forming protrusion portions 147*a*, and the support tube flow path, which is formed in a space between the straw 149 and the support tube flow path forming protrusions 148*a*.

In this way, when the container storage space 111*a* is connected to the intermediate storage chamber 150*a*, the operating shaft 145 is lifted to generate a negative pressure in the intermediate storage chamber 150*a*, and the mixed cosmetics in the container storage space 111*a* flow into the intermediate storage chamber 150*a* through the support tube flow path (see FIG. 8).

Next, when the push button 114 is pressed downward, the pressure tube 119 is lowering alone by a distance spaced apart from the pumping piston 141, and then the pressure tube 119 is lowering together with the pumping piston 141.

The operating shaft flow path 145*a* communicates with the intermediate storage chamber 150*a* while the pressure tube 119 is lowering alone by the distance spaced apart from the pumping piston 141.

When the operating shaft flow path 145*a* communicates with the intermediate storage chamber 150*a*, the mixed cosmetics in the intermediate storage chamber 150*a* sequentially pass through the operating shaft flow path 145*a*, the pressure tube 119, and the button flow path 114*a* to be discharged to the outside.

On the other hand, when the push button 114 is lowering, the return spring 144 accumulates elastic force.

Next, when the pressing force to the push button 114 is released, the push button 114 is lifted to the original position by the elastic force accumulated in the return spring 144.

When the push button 114 is raised, the operating shaft 145 and the pumping piston 141 are lifted, and the operating shaft flow path 145*a* is closed by the pumping piston 141.

When the operating shaft 145 is lifted, a negative pressure is generated in the intermediate storage chamber 150*a*, and the mixed cosmetics in the container storage space 111*a* flow into the intermediate storage chamber 150*a*.

A conventional receptacle for mixing different materials having the above-described configuration is disclosed in a Utility Model Application No. 2002-0015583 (Title of Utility Model: MIXED COSMETIC CONTAINER).

However, according to the conventional container for mixing different materials, since different materials are mixed by a method of lowering the auxiliary storage space sealing plate portion 162 though the operating rod 146, the opening and closing recessed groove portion 147, and the straw support tube 148, which are installed in the cylinder 150, there has been a problem in that the configuration for mixing different materials is complicated and the product is difficult to assemble.

Since the operating rod 146, the opening and closing recessed groove portion 147, and the straw support tube 148 are disposed in the cylinder 150, there has been a problem in that the size of the intermediate storage chamber 150*a* is reduced due to the configuration of mixing different materials.

DISCLOSURE

Technical Problem

The present invention is invented to meet the needs of the above conventional technology, and it is an object of the present invention to provide a receptacle for mixing different materials, in which an inner receptacle is inserted into an outer receptacle, one of pump sets is mounted in the inner receptacle, respectively, thereby storing cosmetic contents different from each other in the inner receptacle and the outer receptacle and using them simultaneously by one pumping.

Technical Solution

A receptacle for mixing different materials according to a first embodiment of the present invention, includes: an outer receptacle 10 for accommodating cosmetic contents; an inner receptacle 20 of a columnar member for accommodating cosmetic contents, the upper part of which is opened and the lower part thereof is closed, which has an upper flange 25 placed over some of the inner circumference of the upper opening portion 11 of the outer receptacle 10 and an elliptical first pump set 31 is inserted into the inside the upper surface thereof; an elliptical second pump set 32 mounted in parallel with the elliptical first pump set 31 on one side of the inner receptacle 20; a shoulder member 50, the upper part of which is opened, and on the inner circumference thereof, a female screw is formed so that the lower part is screw-coupled to the upper opening portion 11 of the outer receptacle 10 at the lower outside thereof, and an intermediate part is fixed by pressing the upper flange 25 of the inner receptacle 20 and at the same time, the first and the second pump housings 52, 53, into which the first and the second pump sets 31, 32 are inserted, respectively, are formed integrally; a push button 60 which is fixed to the upper side of the first and the second pump sets 31, 32 to discharge cosmetic contents to the outside by pressing the first and the second pump sets 31, 32; and a cover member 70 covering the push button 60 of a cylindrical member, only the lower part of which is opened, which is coupled to a circumferential protrusion 51 formed on the upper outer circumference of the shoulder member 50.

The inner receptacle 20 is divided into: a circular portion 26 formed such that the outer circumference is closely mounted on the inner circumference of the upper opening portion 11 of the outer receptacle 10; and an elliptical portion 27 formed such that the second pump set 32 is closely mounted on the surface facing the circular portion 26.

Advantageous Effects

According to a receptacle for mixing different materials of the present invention, the shoulder member 50 is integrally formed with the first and the second pump housings 52, 53, into which the first and the second elliptic pump sets 31, 32 are respectively inserted to be rigid, and one of the first and the second pump housings 52, 53 is inserted into the inner receptacle 20, thereby storing cosmetic contents different from each other in the outer receptacle 10 and the inner receptacle 20 and using them simultaneously by one pumping.

BEST MODE

Figure 1:
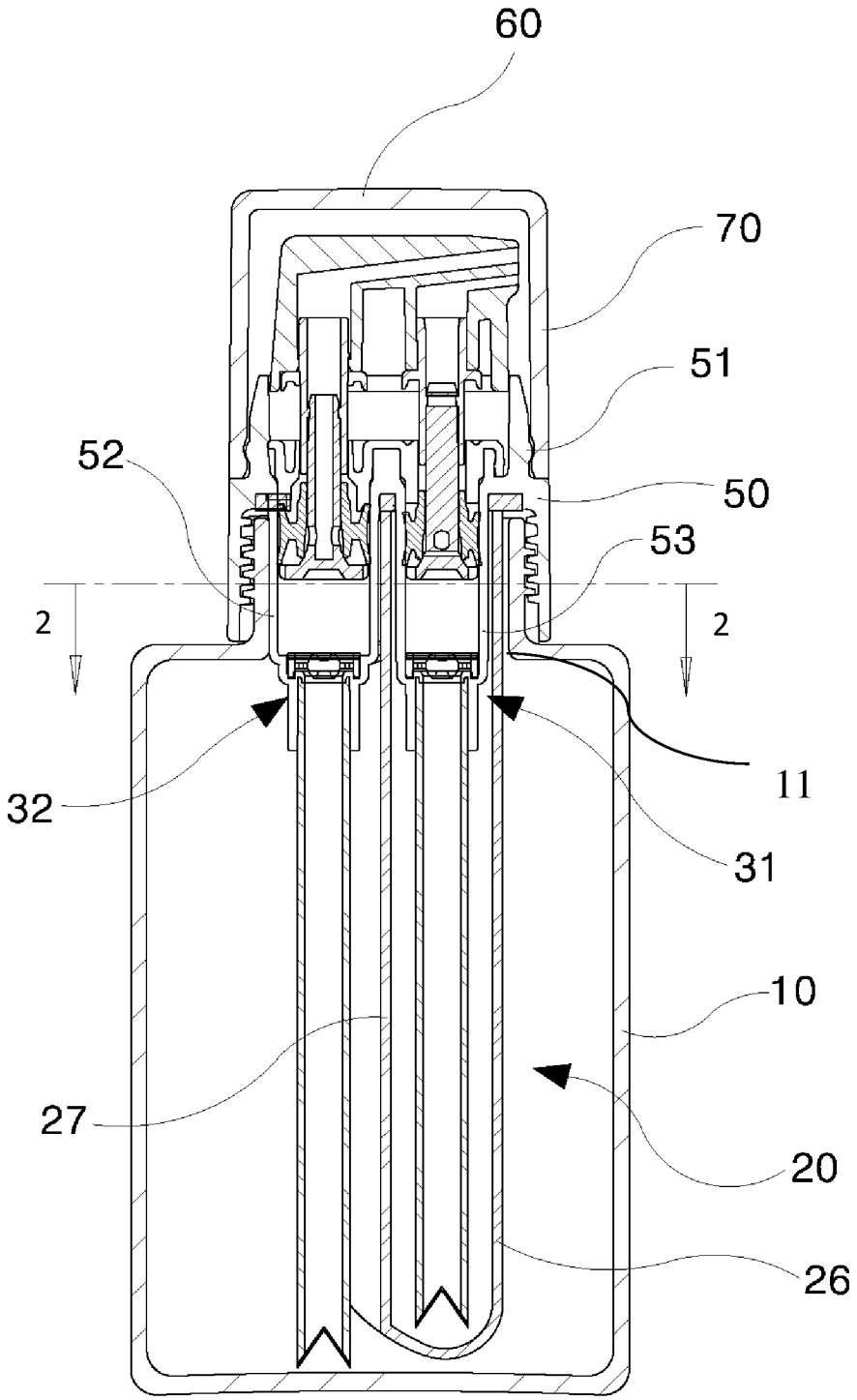
FIG. 1 is a cross-sectional view showing a receptacle for mixing different materials according to a first embodiment of the present invention.

Hereinafter, preferred embodiments of the present invention will be described in detail with reference to the accompanying drawings so that these can easily be carried out by those skilled in the art. It should be noted that reference numerals shown in the attached drawings are used throughout the different drawings to denote the same components whenever possible. In addition, in describing the present invention, the detailed description of known functions or known configurations incorporated herein will be omitted if it is deemed that it may unnecessarily obscure the gist of the present invention. Some features shown in the drawings are magnified, reduced, or simplified for ease of explanation, and the drawings and their components are not necessarily illustrated at an appropriate rate. However, those skilled in the art will easily understand these details.

It will be understood that the terms including ordinals such as "first," "second," etc. may be used herein to describe various components, but these components are not limited to the terms. These terms are used only to distinguish one component from another component. For example, the first component may be referred to as a second component without departing from the scope of the claims of the present invention, and similarly, the second component may also be referred to as a first component. The term "and/or" includes any combination of a plurality of related listed items or any of a plurality of related listed items.

In addition, related terms described on the basis of what is shown in the drawings such as "front," "rear," "top," "below," and the like may be replaced with ordinals such as "first," "second," and the like.

The ordinal numbers such as "first," "second," and the like are arbitrarily set in the order described, and thus the order may be arbitrarily changed as necessary.

The terminology used herein is for the purpose of describing particular embodiments only and is not intended to be limiting of the invention. The singular forms comprise plural referents unless the context clearly dictates otherwise. It is to be understood that the terms such as "comprise" or "have" as described in the present specification, are intended to designate the presence of stated features, numbers, steps, operations, components, parts or combinations thereof, but not to preclude the possibility of the presence or addition of one or more other features, numbers, steps, operations, components, parts, or combinations thereof.

Unless otherwise defined, all terms including technical and scientific terms used herein have the same meaning as commonly understood by those skilled in the art to which the present invention pertains. The terms defined in commonly used dictionaries should be interpreted as having a meaning that is consistent with their meaning in the context of the relevant arts, and will not be interpreted in an idealized or overly formal meaning unless expressly so defined herein.

Hereinafter, preferred embodiments of the present invention will be described in detail with reference to the accompanying drawings. In addition, in describing the present invention, the detailed description of known configurations or functions incorporated herein will be omitted if it is deemed that it may unnecessarily obscure the gist of the present invention.

First Embodiment

Figure 2:
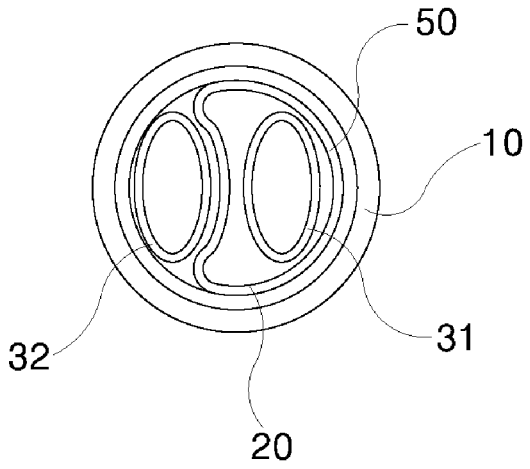
FIG. 2 is a cross-sectional view taken along the line 2-2 in FIG. 1.

FIG. 1 is a cross-sectional view showing a receptacle for mixing different materials according to a first embodiment of the present invention; FIG. 2 is a cross-sectional view taken along the line 2-2 in FIG. 1; and FIG. 3 is a perspective view showing an inner receptacle of the receptacle for mixing different materials according to the first embodiment of the present invention.

Figure 3:
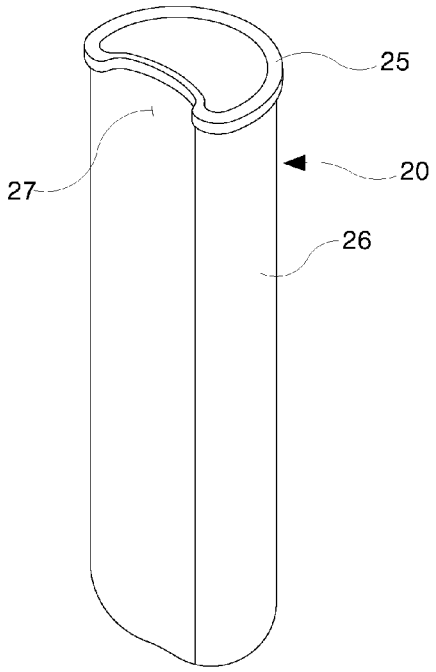
FIG. 3 is a perspective view showing an inner receptacle of the receptacle for mixing different materials according to the first embodiment of the present invention.
Figure 4:
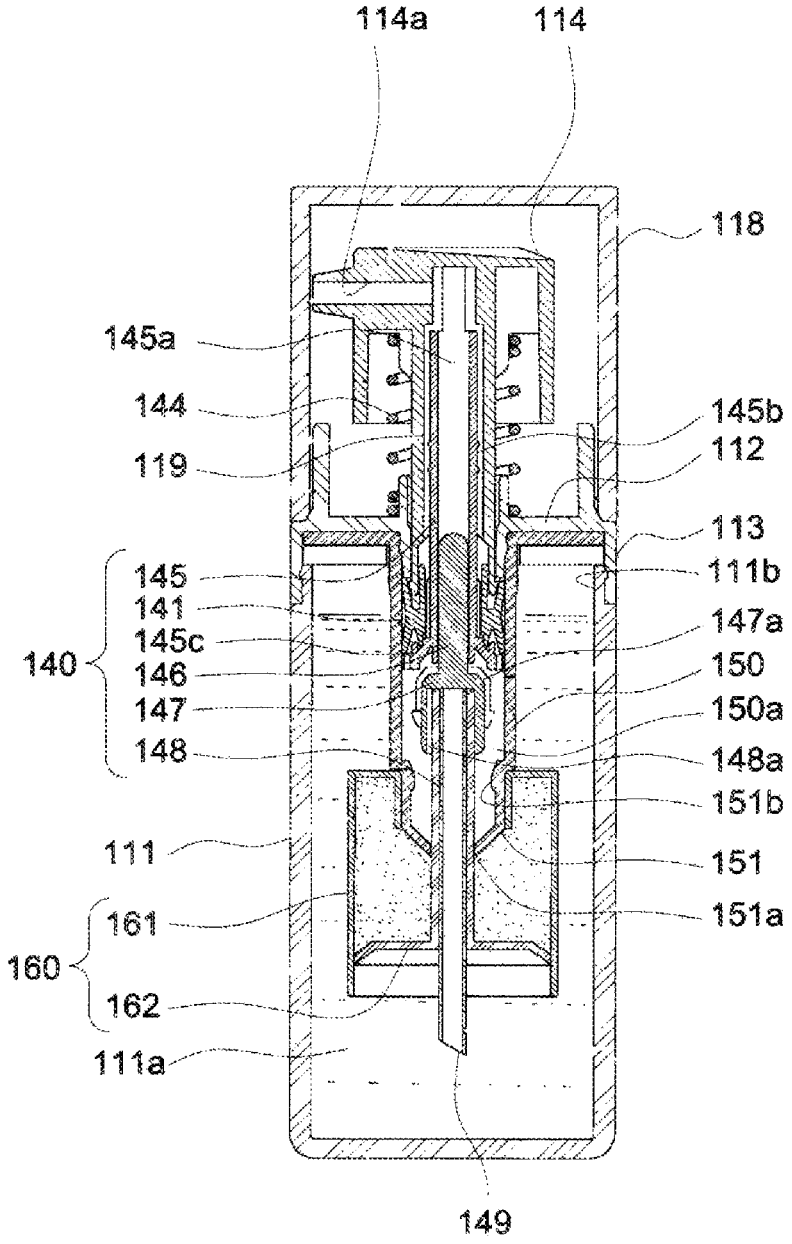
FIG. 4 PRIOR ART
FIGS. 4 and 5 are cross-sectional views of a conventional receptacle for mixing different materials.
Figure 5:
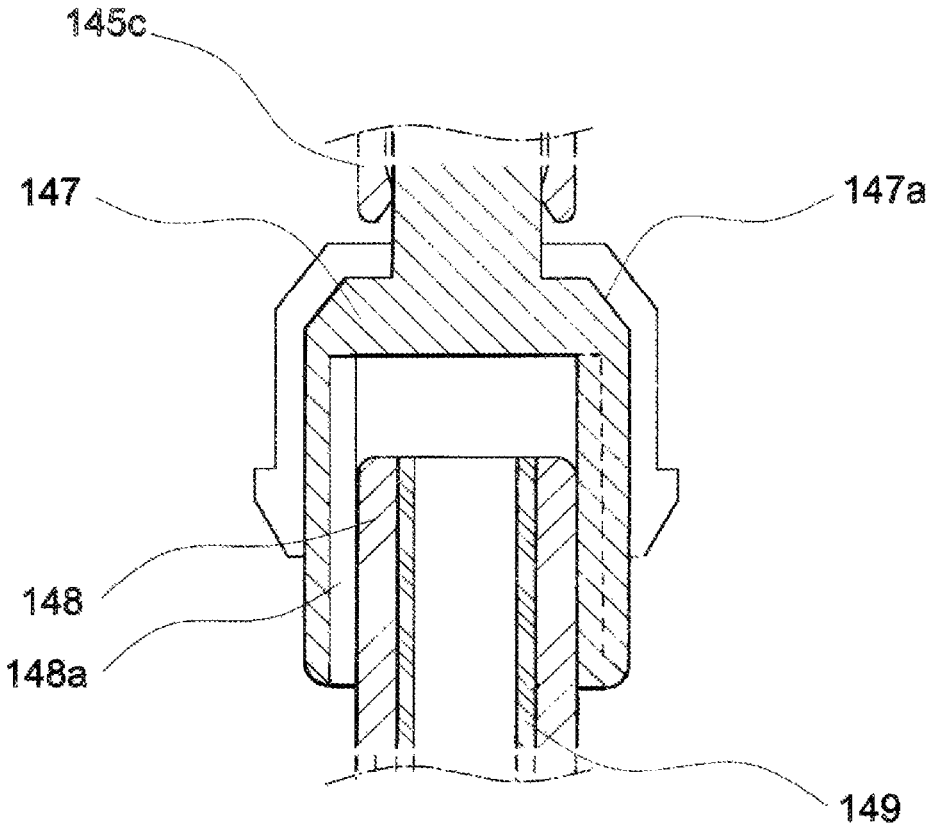
FIG. 5 PRIOR ART
Figure 6:
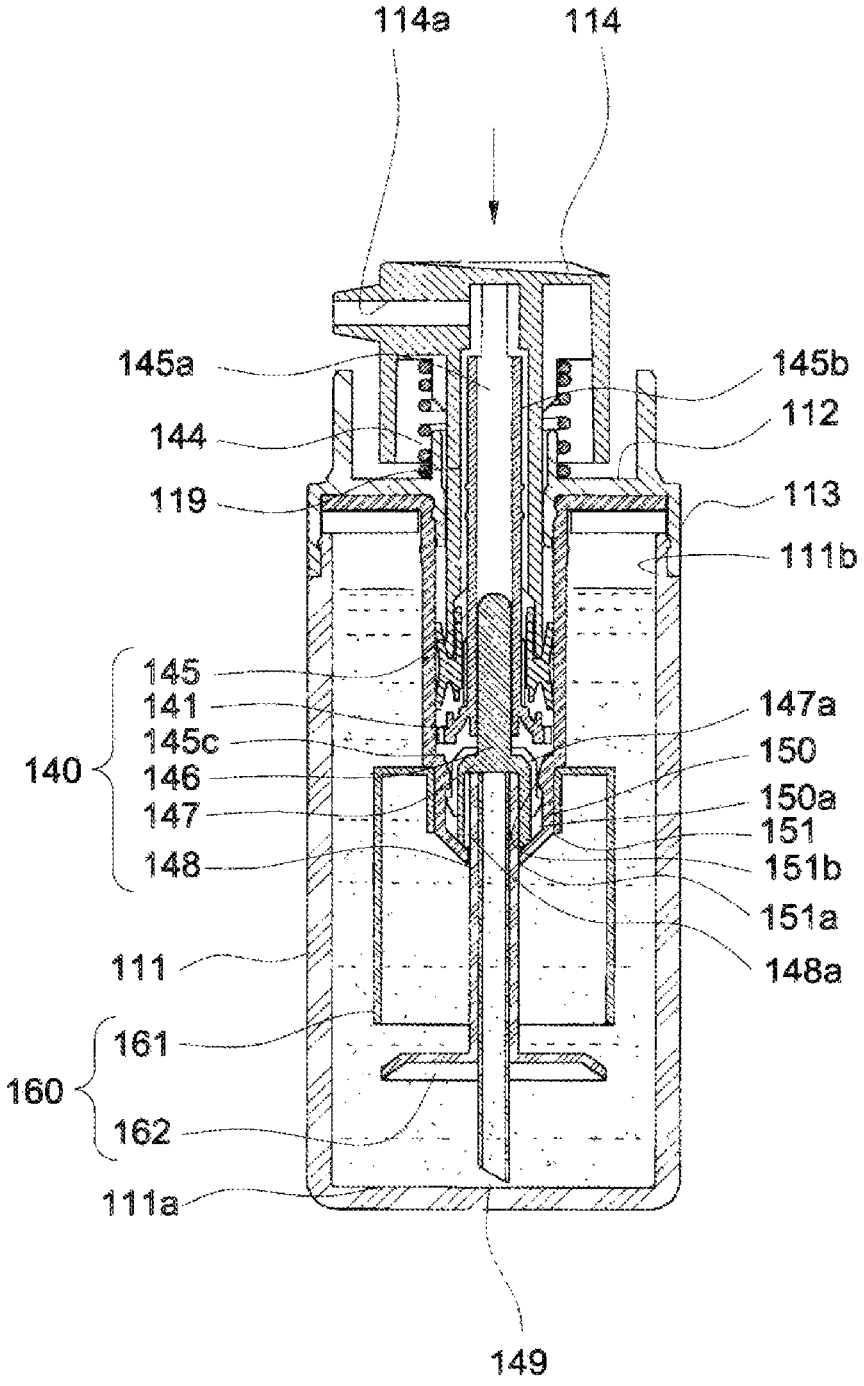
FIG. 6 PRIOR ART
FIGS. 6 and 7 are diagrams showing a method of using a conventional receptacle for mixing different materials, respectively.
Figure 7:
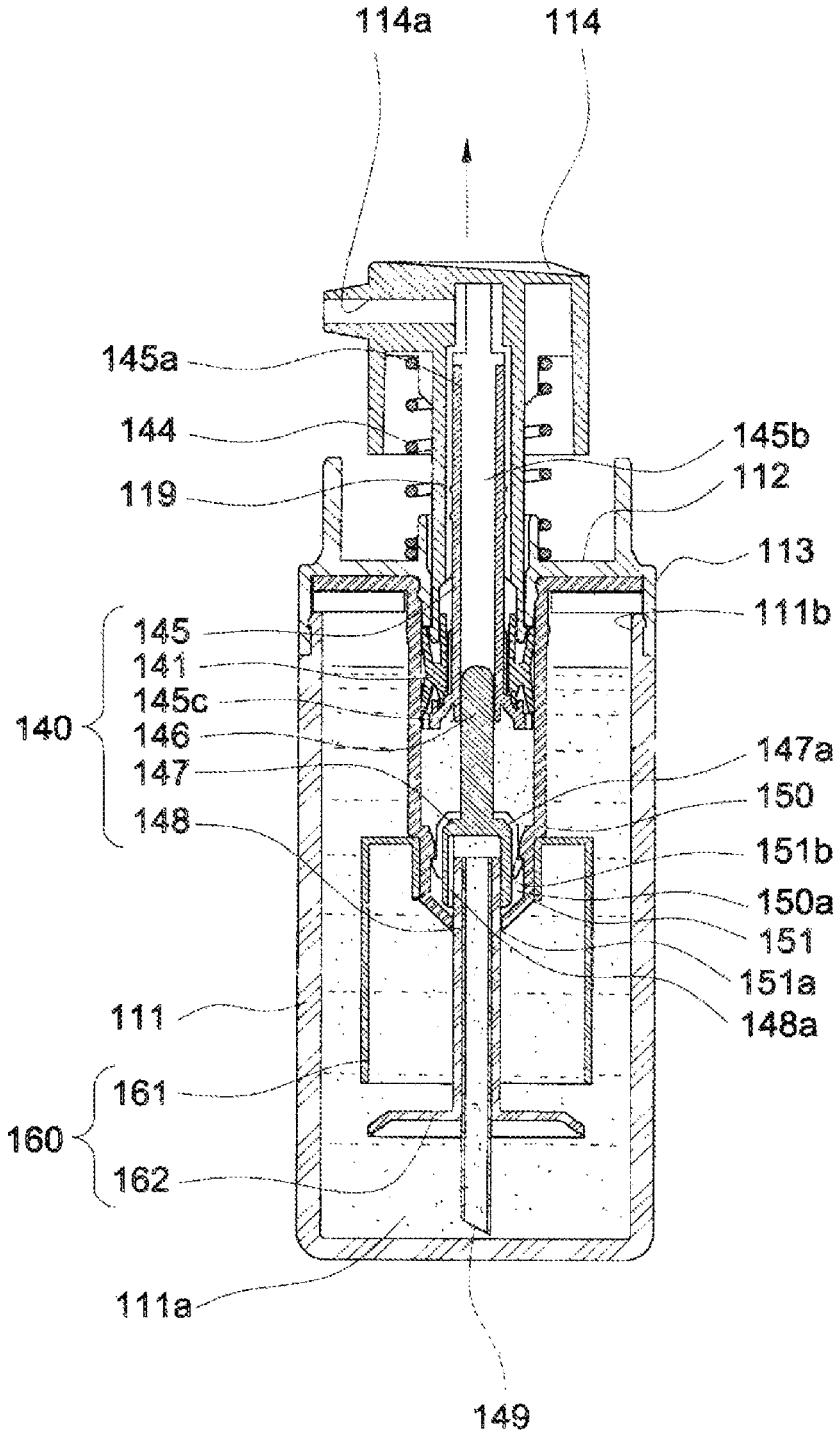
FIG. 7 PRIOR ART

As shown in FIGS. 1 to 3, the receptacle for mixing different materials according to a first embodiment of the present invention includes: an outer receptacle 10 for accommodating cosmetic contents; an inner receptacle 20 of a columnar member for accommodating cosmetic contents, the upper part of which is opened and the lower part thereof is closed, which has an upper flange 25 placed over some of the inner circumference of the upper opening portion 11 of the outer receptacle 10 and an elliptical first pump set 31 is inserted into the inside the upper surface thereof; an elliptical second pump set 32 mounted in parallel with the elliptical first pump set 31 on one side of the inner receptacle 20; a shoulder member 50, the upper part of which is opened, and on the inner circumference thereof, a female screw is formed so that the lower part is screw-coupled to the upper opening portion 11 of the outer receptacle 10 at the lower outside thereof, and an intermediate part is fixed by pressing the upper flange 25 of the inner receptacle 20 and at the same time, the first and the second pump housings 52, 53, into which the first and the second pump sets 31, 32 are inserted, respectively, are formed integrally; a push button 60 which is fixed to the upper side of the first and the second pump sets 31, 32 to discharge cosmetic contents to the outside by pressing the first and the second pump sets 31, 32; and a cover member 70 covering the push button 60 of a cylindrical member, only the lower part of which is opened, which is coupled to a circumferential protrusion 51 formed on the upper outer circumference of the shoulder member 50.

The inner receptacle 20 is divided into: a circular portion 26 formed such that the outer circumference is closely mounted on the inner circumference of the upper opening portion 11 of the outer receptacle 10; and an elliptical portion 27 formed such that the second pump set 32 is closely mounted on the surface facing the circular portion 26.

The first and the second pump sets 31, 32 have one selected from circular and elliptical outer shapes. The pump set has preferably an elliptical shape.

The receptacle for mixing different materials according to the second embodiment of the present invention as described above is configured such that the inner receptacle 20 on which the first pump set 31 is mounted is mounted on one side of the second pump set 32, that is, on the inner circumference of the upper opening portion 11 of the outer receptacle 10, thereby storing cosmetic contents different from each other in the outer receptacle 10 and the inner receptacle 20 and using simultaneously them by one pumping.

As described above, while the present invention has been described with reference to exemplary embodiments thereof in the detailed description, it is obvious that the techniques of the present invention are easily modified by those skilled in the art, and these modified embodiments will be included in the technical idea described in the claims of the present invention.

The invention claimed is:

1. A receptacle for mixing different materials, comprising:

an outer receptacle for accommodating cosmetic contents;

an inner receptacle of a columnar member for accommodating cosmetic contents, an upper part of which is opened and a lower part thereof is closed, which has an upper flange placed over some of an inner circumference of an upper opening portion of the outer receptacle and an elliptical first pump set inserted into an inside of an upper surface thereof;

an elliptical second pump set mounted in parallel with the elliptical first pump set on one side of the inner receptacle;

a shoulder member, an upper part of which is opened, and on an inner circumference thereof, a female screw is formed so that a lower part of the shoulder member is screw-coupled to the upper opening portion of the outer receptacle at a lower outside thereof, and an intermediate part is fixed by pressing the upper flange of the inner receptacle, wherein a first and a second pump housings, into which the first and the second pump sets are inserted, respectively, are formed integrally;

a push button (60) which is fixed to an upper side of the first and the second pump sets to discharge cosmetic contents to an outside by pressing the first and the second pump sets; and a cover member covering the push button of a cylindrical member, only a lower part of which is opened, which is coupled to a circumferential protrusion formed on an upper outer circumference of the shoulder member (50).

2. The receptacle for mixing different materials according to claim 1, wherein the inner receptacle is divided into:

a circular portion formed such that an outer circumference thereof is closely mounted on an inner circumference of the upper opening portion of the outer receptacle; and an elliptical portion formed such that the second pump set is closely mounted on a surface facing the circular portion.

3. The receptacle for mixing different materials according to claim 2, wherein the first and the second pump sets respectively have one of circular and elliptical outer shapes.

* * * * *